US010699682B1

(12) United States Patent
Allen

(10) Patent No.: US 10,699,682 B1
(45) Date of Patent: Jun. 30, 2020

(54) SNARE DRUM WITH A SNARE BED CREATED FROM A CONTINUOUS CURVE

(71) Applicant: Joshua Allen, Portage, MI (US)

(72) Inventor: Joshua Allen, Portage, MI (US)

(73) Assignee: Independent Drum Lab LLC, Portage, MI (US)

( * ) Notice: Subject to any disclaimer, the term of this patent is extended or adjusted under 35 U.S.C. 154(b) by 0 days.

(21) Appl. No.: 16/654,123

(22) Filed: Oct. 16, 2019

(51) Int. Cl.

| | |
|---|---|
| ***G10D 3/02*** | (2006.01) |
| ***G10D 13/02*** | (2020.01) |
| ***G10D 13/18*** | (2020.01) |
| ***G10D 13/20*** | (2020.01) |
| ***G10D 13/22*** | (2020.01) |

(52) U.S. Cl.
CPC ..... *G10D 13/02* (2013.01); *G10D 13/18* (2020.02); *G10D 13/20* (2020.02); *G10D 13/22* (2020.02)

(58) Field of Classification Search
CPC ..... G10D 13/02
See application file for complete search history.

(56) References Cited

U.S. PATENT DOCUMENTS

| | | | | | |
|---|---|---|---|---|---|
| 4,967,634 | A * | 11/1990 | Whynott | G10D 13/18 | 84/413 |
| 5,419,230 | A * | 5/1995 | Ocheltree | G10D 13/02 | 84/415 |
| 7,435,887 | B2 * | 10/2008 | Nickel | G10D 13/18 | 84/415 |
| 9,076,414 | B1 * | 7/2015 | Dunnett | G10D 13/22 | |
| D868,145 | S * | 11/2019 | Pawlovich | D17/22 | |
| 10,497,345 | B2 * | 12/2019 | Pawlovich | G10D 13/02 | |
| 2020/0105234 | A1 * | 4/2020 | Pawlovich | G10D 13/16 | |

* cited by examiner

*Primary Examiner* — Robert W Horn
(74) *Attorney, Agent, or Firm* — Heed Law Group PLLC; Thomas P. Heed

(57) ABSTRACT

A snare drum with a snare bed created by a continuous curve in the lower edge of the snare drum shell is disclosed. The continuous curve has two maxima and two minima. The continuous curve is cut into the snare drum shell blank, from which the snare drum shell is bent. The continuous curve can be sinusoidal, polynomial, or spline. The two minima are disposed opposite one another when the shell is formed. The snare bed thus created provides superior tuning, reduced buzzing, and improved sensitivity.

14 Claims, 5 Drawing Sheets

SNARE DRUM WITH A SNARE BED CREATED FROM A CONTINUOUS CURVE

FIELD OF INVENTION

This invention relates to the class of musical instruments; and to one or more sub-categories of drums or tambourines. Specifically, this invention relates to the shape of a snare drum bed.

BACKGROUND OF INVENTION

Drums are the simplest, and most primitive, musical instruments. The drum is a percussive instrument, which produces sound by striking a membrane. The sound is propagated through a membrane, or drumhead, to the drum shell, which is designed to resonate when the membrane is struck. The drumhead is coupled to the drum shell through drum hoops, lugs, and lug or hoop holders. The energy created by striking the drumhead is transferred into a wave in the drum shell, producing the distinctive drum sound, a tuned impulse.

While drums usually cannot play different pitches, they are usually tuned. The drum is tuned by tightening or loosening the drumhead by adjusting the lugs and drum hoops. The tighter the drumhead, the higher the pitch propagated by the drumhead. There are a variety of drums, including, but not limited to a bass or kick drum, snare drums, and tom drums A snare drum has a top and bottom drumhead. Snare wires are adjustably attached to the exterior of the drum shell, and held in tension against the membrane of the bottom drumhead. Snare beds are a feature of the bottom edge of nearly all snare drums shells. A snare bed is an indentation in the bottom edge of the snare drum shell that creates a curve in the bottom drumhead for the snare wires to curve against. Snare beds are an important part of the sound of the snare drum. They control how responsive and sensitive the snare wires are, and how much the wires buzz or rattle when the drum isn't being played. The snare bed also affects tuning. It can be difficult to get an even tension on the bottom drumhead around the contour of the snare bed.

There are a lot of different designs for the shape of the snare beds, but all are based around a level, straight edge most of the way around the bottom edge of the snare drum shell. Typically, the snare bed is only cut or bent into a small section on either side of the bottom edge of the snare drum shell, where the snare wires cross. Some are wider than others, but all leave a level edge around most of the drum. In other words, the bottom edge of the snare drum shell is a discontinuous curve, because of the cut-out for the snare bed. Current snare beds, although necessary, make it difficult to properly tune snare drums, create unwanted buzzes from the snare wires, and reduce the overall sensitivity of the snare wires.

SUMMARY OF THE INVENTION

This summary is intended to disclose the present invention, a snare drum with a snare bed created from a continuous curve. The embodiments and descriptions are used to illustrate the invention and its utility, and are not intended to limit the invention or its use. The present invention, a snare drum with a snare bed created from a continuous curve, is easier to tune, reduces unwanted buzzing, and has increased sensitivity when compared with other snare drum beds.

A snare drum has a rigid snare drum shell, which is typically bent from a snare drum shell blank. The snare drum shell blank is typically fabricated from wood, such as birch, beech, maple, oak, as solid wood or in multiple ply plywood; or metal such as brass, copper, aluminum, steel, stainless steel, or titanium.

The snare drum shell blank of the present invention has two serrated side edges, an upper edge, a lower edge, a front or outer surface, and a rear or inner surface. The serrated side edges of the snare drum shell blank have a plurality of notches and recesses, which join the rigid snare drum shell into a cylinder when the snare drum shell blank is bent. The notches and recesses are secured as a finger-joint with a retaining plate using threaded fasteners or rivets. Alternatively, the snare drum shell can be formed seamlessly using a variety of procedures well known in the art. The snare drum shell blank has a plurality of holes used to mount the lugs, and a plurality of holes used to mount a snare strap retainer.

When formed into a cylinder, the lower edge is a continuous curve has two maxima and two minima. When a snare drum shell blank of the present invention is rolled into the cylindrical rigid snare drum shell, the minima will form a snare bed. The minima are disposed across the rigid snare drum shell from one another.

A snare drum is constructed by attaching a plurality of lugs to the rigid snare drum shell by threading a plurality of fasteners through the holes in the rigid snare drum shell. An upper drum hoop is placed over an upper membrane, called a drumhead. A separate plurality of threaded fasteners fit through the drum hoop and attach to the lugs. In a like manner, two snare strap retainers are attached to the rigid snare drum shell with fasteners.

A lower drum hoop attaches a lower drumhead to the rigid snare drum shell using a separate plurality of threaded fasteners. The plurality of threaded fasteners attaches the lower drum hoop to the plurality of lugs mounted to the exterior surface of the rigid snare drum shell. The minima of the lower edge form the snare bed. The snare wires are attached to a snare butt, which, in turn, attaches to a snare strap. A snare strap opening is built into the lower drum hoop. The snare strap opening is aligned with the snare bed and the snare strap retainer. The snare strap is attached to the snare strap retainer.

The snare bed is created with a continuous curve along the lower edge. The continuous curve has two maxima and two minima. The continuous curve can be a sinusoid, a polynomial, or a spline. With modern computer aided design tools, the only requirement is that the continuous curve be continuous and have two maxima and two minima.

The snare bed that is created with a continuous curve is easier to tune, reduces buzzing, and increases sensitivity.

BRIEF DESCRIPTION OF THE DRAWINGS

The present invention is illustrated with 5 drawings on 3 sheets.

DETAILED DESCRIPTION OF THE DRAWINGS

The following descriptions are not meant to limit the invention, but rather to add to the summary of invention, and illustrate the present invention, a snare drum with a snare bed created from a continuous curve. The present invention is illustrated with a variety of drawings showing various possible embodiments.

Figure 1:
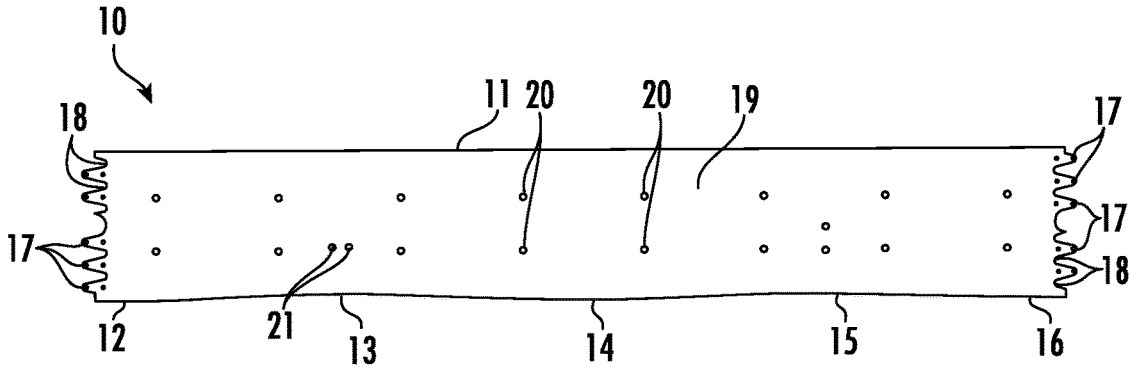
FIG. 1 is front illustration of a snare drum shell blank.
Figure 2:
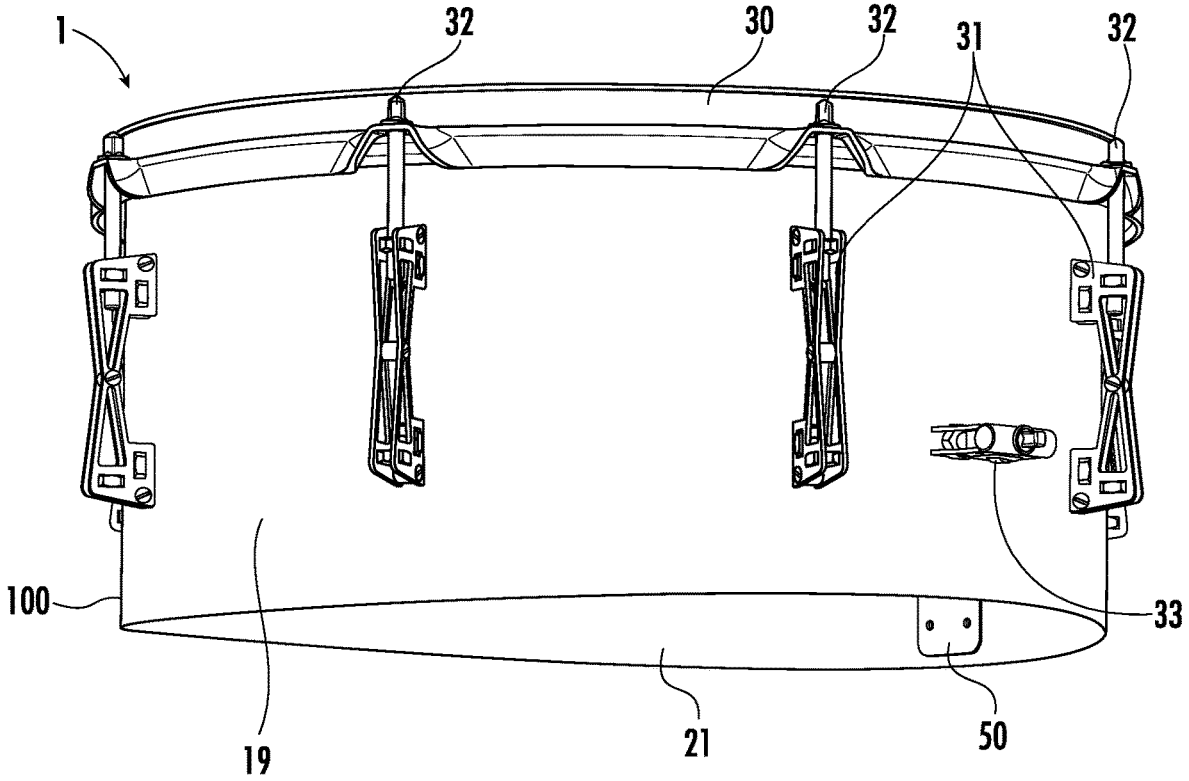
FIG. 2 is a perspective view of a partially built snare drum.
Figure 4:
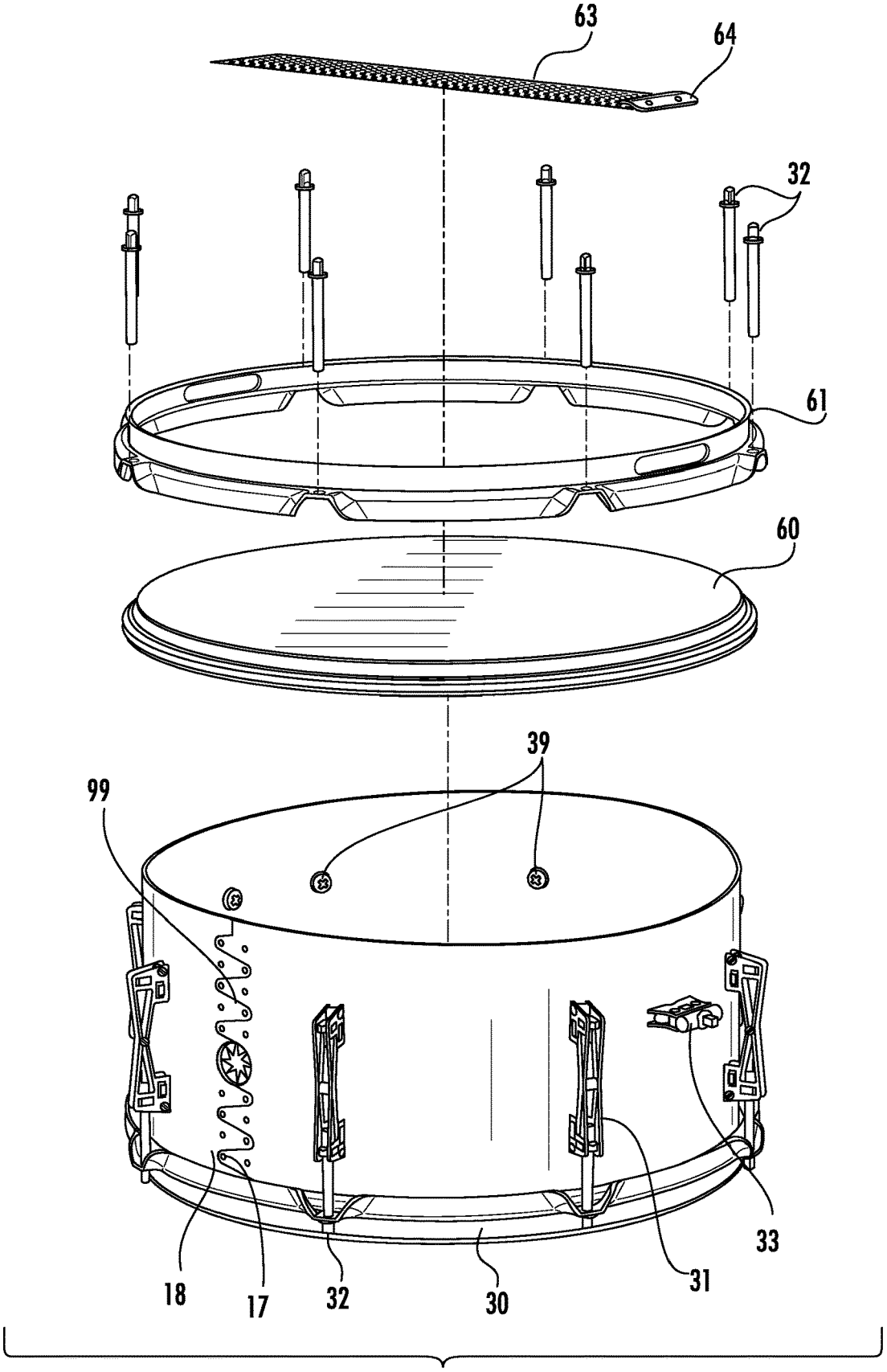
FIG. 4 is a partially exploded bottom view of the present invention.
Figure 5:
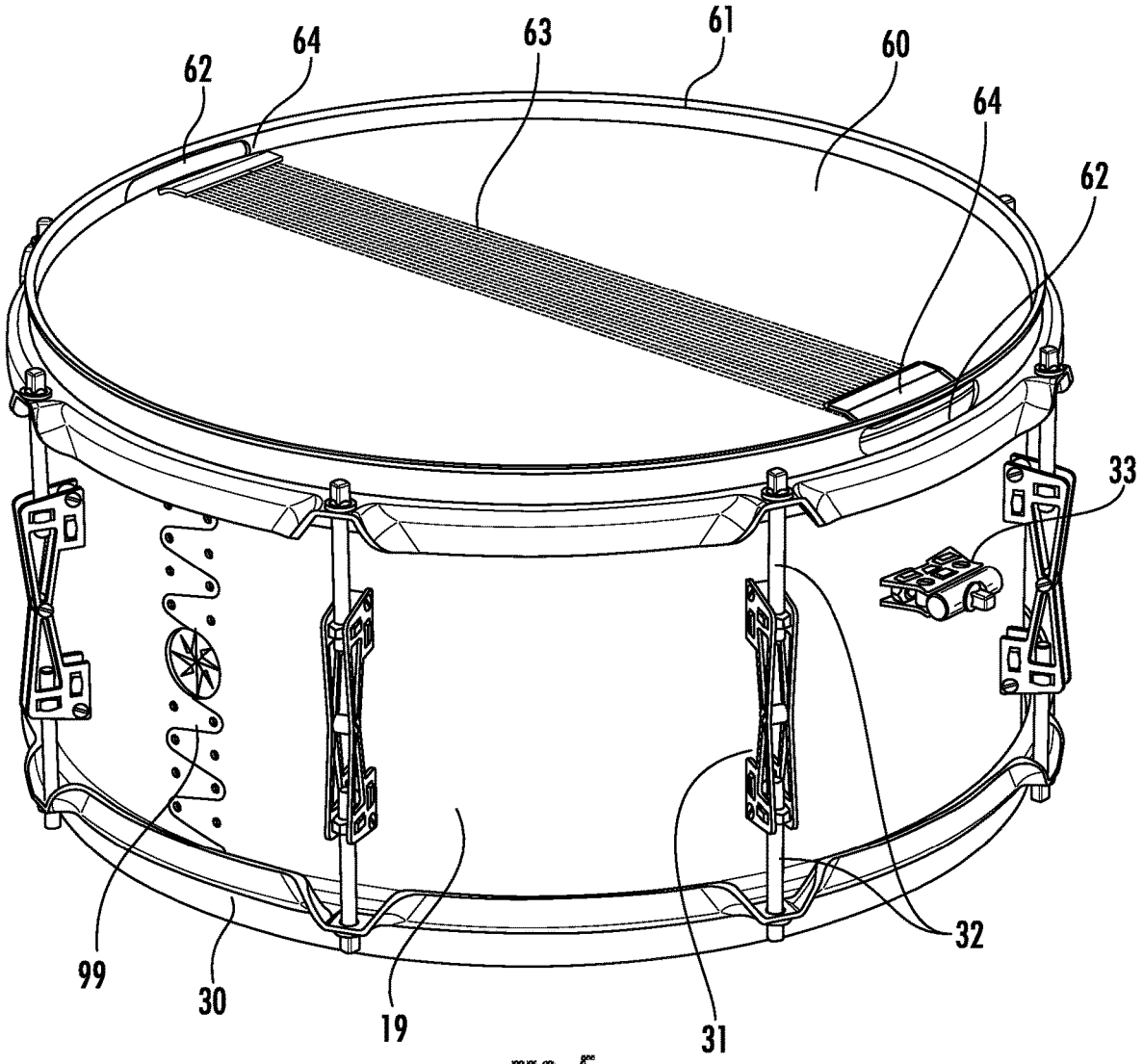
FIG. 5 is a perspective view of the present invention.

Referring to FIGS. 1 and 2, a snare drum 1 has a rigid snare drum shell 100 that is formed from a snare drum shell blank 10. The snare drum shell blank 10 is typically cut from wood. The snare drum shell blank 10 is typically constructed from one or more of birch, beech, maple, oak, two-ply plywood, and three-ply plywood. The snare drum shell blank 10 has an upper edge 11, a lower edge 12, 13, 14, 15, 16, a front or outer surface 19, and a rear or inner surface 21. The serrated side edges 99 (see FIGS. 4 and 5) of the snare drum shell blank 10 have a plurality of notches 17 and recesses 18. The snare drum shell blank 10 is slowly bent into a cylindrical rigid snare drum shell 100. The notches 17 and recesses 18 are used to join the two ends of the snare drum shell blank 10 into a cylindrical rigid snare drum shell 100. The notches 17 and recesses 18 attach to a retaining plate 50 with threaded fasteners. The snare drum shell blank 10 has a plurality of holes 20 with which to mount the lugs 31 and a plurality of holes 21 with which to mount a snare strap retainer 33.

The lower edge 12, 13, 14, 15, 16 has two maxima 12, 16 (when formed into a cylinder, they constitute a single maxima) and 14. The lower edge 12, 13, 14, 15, 16 has two minima 13, 15. When the snare drum shell blank 10 is rolled into the cylindrical rigid snare drum shell 100, the minima 13, 15 will form a snare bed 13, 15. The minima 13, 15 are disposed across the rigid snare drum shell 100 from one another.

Referring to FIGS. 1-5, a snare drum 1 is constructed by screwing a plurality of lugs 31 to the rigid snare drum shell 100 by threading a plurality of fasteners 39 through the holes 20 in the rigid snare drum shell 100. An upper drum hoop 30 is placed over an upper membrane, called a drumhead. A separate plurality of threaded fasteners 32 fit through the drum hoop 30 and attach to the lugs 31. Likewise, two snare strap retainer 33 are attached to the rigid snare drum shell 100 with fasteners. The snare strap retainers 33 are disposed opposite one another on the rigid snare drum shell 100.

Figure 3A:
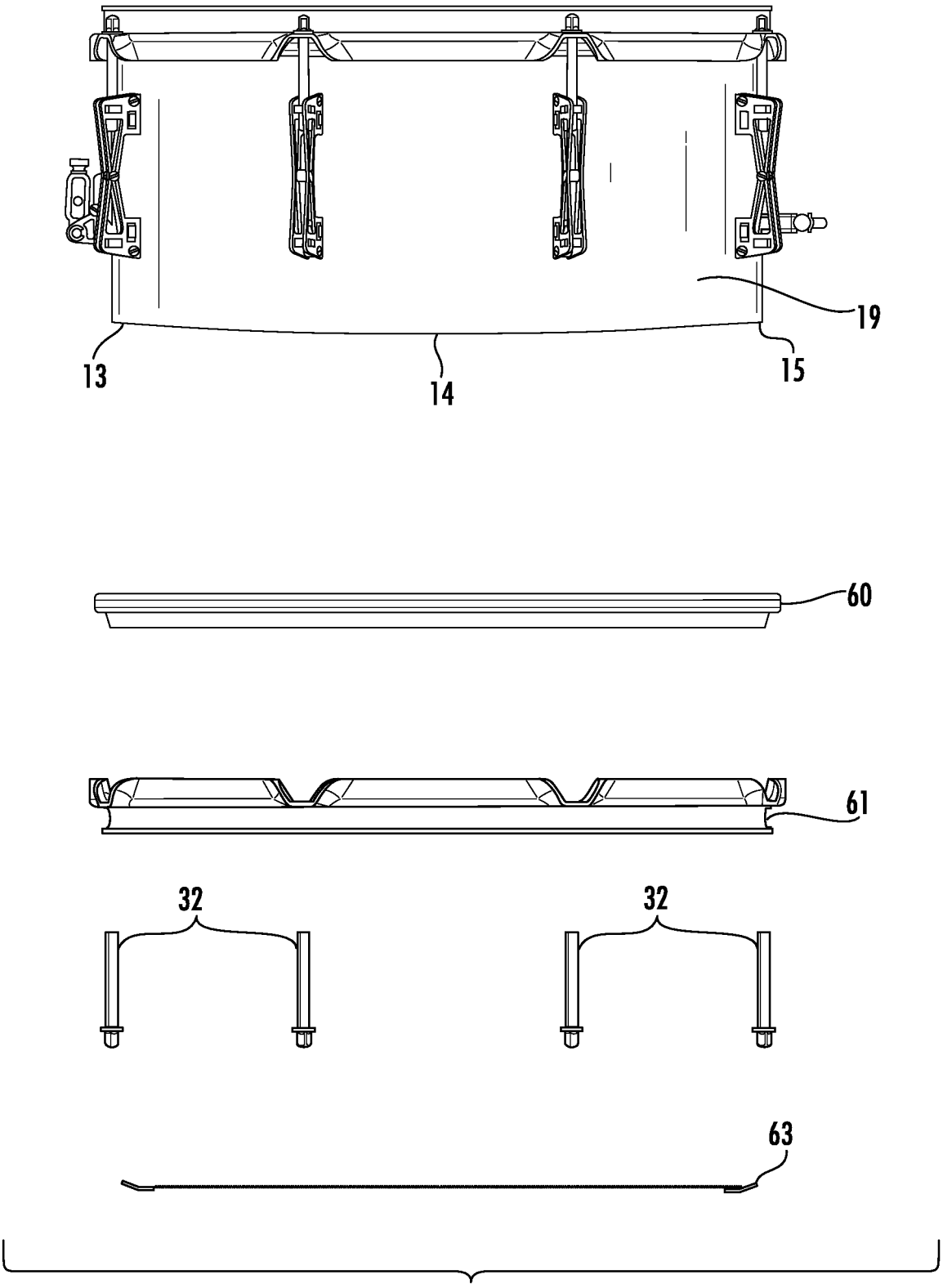
FIG. 3A is a partially exploded side view of a snare drum with a lower-edge maxima centered and visible.
Figure 3B:
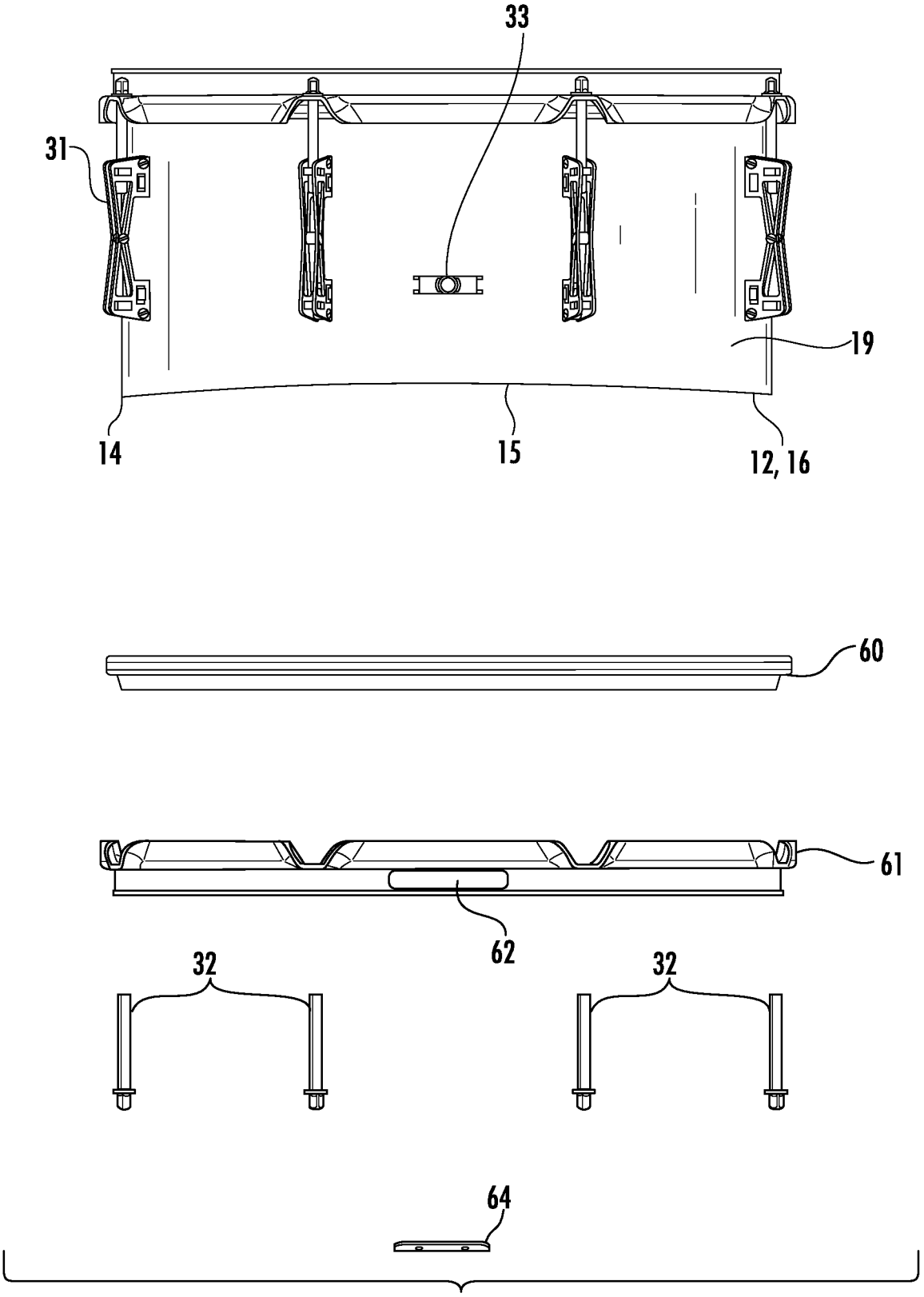
FIG. 3B is a partially exploded side view of a snare drum with a lower-edge minima centered and visible.

Referring to FIGS. 3A and 3B, a lower drum hoop 61 attaches a lower drumhead 60 to the rigid snare drum shell 100 using a separate plurality of threaded fasteners 32. The plurality of threaded fasteners 32 attached the lower drum hoop 61 to the plurality of lugs 31 mounted to the exterior surface 19 of the rigid snare drum shell 100. One maxima 14 and two minima 13, 15 of the lower edge 12, 13, 14, 15, 16 of the rigid snare drum shell 100 are visible in FIG. 3A. One minima 15 and two maxima 12, 16 and 14 of the lower edge 12, 13, 14, 15, 16 of the rigid snare drum shell 100 are visible in FIG. 3B. The minima 13, 15 are the snare bed 13, 15. The snare wires 63 are attached to a snare butt 64, which, in turn, attaches to a snare strap (not shown). A snare strap opening 62 is built into the lower drum hoop 61. The snare strap opening 62 is aligned with the snare bed 13,15 and the snare strap retainer 33. The snare strap is attached to the snare strap retainer 33.

The snare bed 13, 15 is created with a continuous curve 12, 13, 14, 15, 16 along the lower edge 12, 13, 14, 15, 16. The continuous curve 12, 13, 14, 15, 16 has two maxima 12, 16 and 14; and two minima 13,15. The continuous curve 12, 13, 14, 15, 16 can be a sinusoid, a polynomial, or a spline. With modern computer aided design tools, the only requirement is that the continuous curve be continuous and have two maxima and two minima.

The snare bed 13, 15 that is created with a continuous curve 12, 13, 14, 15, 16 is easier to tune, reduces buzzing, and increases sensitivity.

I claim:

1. A snare drum with a snare bed created from a continuous curve comprising a rigid snare drum shell comprised of an inner surface, an outer surface, an upper edge, and a lower edge, an upper membrane, called a drumhead, coupled to the upper edge of the rigid snare drum shell with an upper drum hoop and a plurality of lugs;

a lower drumhead, coupled to the lower edge of the rigid snare drum shell with a lower drum hoop and a plurality of lugs; and snare wires, fastened to the drum shell so that they are in intimate contact with the lower drumhead;

wherein the lower edge of the rigid snare drum shell continuously curves.

2. The snare drum with a snare bed created from a continuous curve of claim 1, wherein the continuous curve of the lower edge of the rigid snare drum shell has two maxima and two minima.

3. The snare drum with a snare bed created from a continuous curve of claim 2, wherein the two minima are disposed across the rigid snare shell from each other; and the two maxima are disposed across the rigid snare shell from each other.

4. The snare drum with a snare bed created from a continuous curve of claim 3, wherein the two minima create a snare bed.

5. The snare drum with a snare bed created from a continuous curve of claim 4, wherein the snare wires attached at the snare bed, allowing the snare wires to be in intimate contact with the lower drumhead.

6. The snare drum with a snare bed created from a continuous curve of claim 5, wherein the continuous curve is a sinusoid.

7. The snare drum with a snare bed created from a continuous curve of claim 5, wherein the continuous curve is created piecewise with splines.

8. The snare drum with a snare bed created from a continuous curve of claim 5, wherein the continuous curve is created with a polynomial.

9. The snare drum with a snare bed created from a continuous curve of claim 4 wherein the rigid snare drum shell is formed from a snare drum shell blank.

10. The snare drum with a snare bed created from a continuous curve of claim 9, wherein the snare drum shell blank has two serrated edges.

11. The snare drum with a snare bed created from a continuous curve of claim 10, wherein the continuous curve is formed on the lower edge of a snare drum shell blank, which is then curved and joined along the serrated edges to form a rigid snare drum shell.

12. The snare drum with a snare bed created from a continuous curve of claim 4, wherein the lower drum hoop has two snare strap openings, disposed opposite one another.

13. The snare drum with a snare bed created from a continuous curve of claim 12, further comprising two snare strap retainers, disposed opposite one another and attached to the rigid snare drum shell with fasteners.

14. The snare drum with a snare bed created from a continuous curve of claim 13, wherein one minima comprising the snare bed, one snare strap retainer, and one snare strap opening in the lower drum hoop are aligned.

* * * * *